US005184904A

United States Patent [19]

Hara et al.

[11] Patent Number: 5,184,904

[45] Date of Patent: Feb. 9, 1993

[54] PAPER FEEDER

[75] Inventors: Kozo Hara; Tsuyoshi Sanada; Yoshiaki Tanaka; Kiyotaka Nihashi, all of Shizuoka, Japan

[73] Assignee: Tokyo Electric Co., Ltd., Tokyo, Japan

[21] Appl. No.: 799,289

[22] Filed: Nov. 27, 1991

[30] Foreign Application Priority Data

Nov. 27, 1990 [JP] Japan ..... 2-327836

[51] Int. Cl.[5] ..... B41J 25/304

[52] U.S. Cl. ..... 400/320; 400/639.1; 400/639.2; 400/705

[58] Field of Search ..... 400/283, 319, 320, 320.1, 400/578, 639.1, 639.2, 703, 705, 705.1, 645, 645.1, 645.3

[56] References Cited

U.S. PATENT DOCUMENTS 4,630,950 12/1986 Chu ..... 400/639.1

4,714,364 12/1987 Takada ..... 400/639.1

*Primary Examiner*—Edgar S. Burr

*Assistant Examiner*—Joseph R. Keating

*Attorney, Agent, or Firm*—Oblon, Spivak, McClelland, Maier & Neustadt

[57] ABSTRACT

A paper width of a sheet of paper is input into a paper width setting section. In case of defining a non-print area at a fore end of the paper, a paper bail roller is manually separated from a platen to output a detection signal A from a paper bail switch. In this case, a paper feeding motor is controlled to be driven by a control device, thereby feeding the paper until the fore end of the paper reaches the paper bail roller. On the other hand, in case of starting printing from the fore end of the paper, an operating section is operated to output a command signal B therefrom. In this case, only when the paper width input into the paper width setting section is determined to be less than a predetermined value by the control device, the paper feeding motor is controlled to be driven by the control device, thereby feeding the paper until the fore end of the paper reaches a position opposed to the printing head, and a centering device is controlled to be driven by the control means, thereby moving a carrier to a transverse center of the paper, so as to suppress separation of opposite side portions of the paper from the platen.

2 Claims, 7 Drawing Sheets

PAPER FEEDER

FIELD OF THE INVENTION AND RELATED ART STATEMENT

The present invention relates to a paper feeder for feeding a sheet of paper between a platen and a printing head.

In general, a printer having a printing head and a platen opposed to the printing head is provided with a paper bail roller for pressing a sheet of paper having passed the printing head against the platen to thereby prevent separation of the paper from the platen. The paper bail roller is adapted to be manually operated to come into contact with or separation from the platen. In loading the paper, a carrier for mounting the printing head is moved along the platen to a transverse center of the paper to be used. Thus, the transverse center of the paper is supported between the printing head and the platen. However since opposite side portions of the paper are separate from the platen, a front end of the paper at the opposite side portions is apt to interfere with the paper bail roller or a paper bail shaft. This phenomenon is remarkable in the case where a width of the paper is large. In a known paper feeder intended to solve this problem, the paper bail roller is manually separated from the platen prior to printing operation, and the separation of the paper bail roller from the platen is detected by a paper bail switch. Then, a paper feeding motor is driven to rotate the platen for a given period of time in response to a detection signal output from the paper bail switch. Thereafter, at the time the fore end of the paper has passed between the platen and the paper bail roller, the paper feeding motor is stopped. Then, the paper bail roller is manually operated to come into contact with the paper on the platen, thereby changing the paper bail switch to end the loading operation.

As another type paper feeder in a high-grade printer, it is known that the above-mentioned loading operation is carried out in accordance with a program installed in the paper feeder such that the paper bail roller is automatically separated from the platen by a driving source such as an electromagnet upon key inputting in an operating section, and the paper bail roller is displaced to the platen when the paper is fed by a predetermined amount.

In the above-mentioned prior art paper feeders, printing is started at the time the fore end of the paper having passed the printing head reaches the paper bail roller. Accordingly, the printing cannot be started from the fore end of the paper, and a wide non-print area is defined in the vicinity of the fore end of the paper. Further, in the case where the paper bail roller is driven by the driving source as mentioned above, a structure of the paper feeder is complicated.

OBJECT AND SUMMARY OF THE INVENTION

It is a first object of the present invention to provide a paper feeder which can automatically change a paper feeding condition according to a paper width of a sheet of paper to be used.

It is a second object of the present invention to provide a paper feeder which can easily set a non-print area on a sheet of paper having a small width.

It is a third object of the present invention to provide a paper feeder which can reliably introduce opposite side portions of a sheet of paper between a platen and a paper bail roller.

According to a first aspect of the present invention, there is provided a paper feeder comprising a housing; a carrier reciprocatably supported to the housing; a printing head fixedly mounted on the carrier; a platen rotatably supported to the housing; a paper feeding motor connected to the platen; a paper bail roller rotatably provided at a position downstream of the printing head with respect to the paper feeding direction and adapted to be brought into contact with or separation from an outer circumference of the platen; means for setting a paper width of a sheet of paper to be used; centering means for moving the carrier to a transverse center of the paper; a paper bail switch for detecting separation of the paper bail roller from the outer circumference of the platen means for commanding paper feeding; a detection circuit for distinguishing a detection signal A output from the paper bail switch from a command signal B output from the commanding means; and control means having an input connected to the detection circuit and the paper width setting means and having an output connected to the paper feeding motor; wherein when the detection signal A is input into the control means, the control means controls to drive the paper feeding motor until a fore end of the paper reaches the paper bail roller, while when the command signal B is input into the control means, and the paper width set by the paper width setting means is less than a predetermined value, the control means controls to drive the centering means and thereby move the carrier to the transverse center of the paper, and controls to drive the paper feeding motor until the fore end of the paper reaches a position opposed to the printing head.

In operation, a paper width of a sheet of paper to be used is input into the paper width setting means. In case of defining a non-print area at the fore end of the paper, the paper bail roller is manually separated from the platen to output the detection signal A from the paper bail switch. On the other hand, in case of starting printing from the fore end of the paper, the commanding means is operated to output the command signal B therefrom. The detection signal A and the command signal B are distinguished from each other by the detection circuit, and either the signal A or the signal B is input into the control means. When the detection signal A is input into the control means, the paper feeding motor is controlled to be driven by the control means, thereby feeding the paper until the fore end of the paper reaches the paper bail roller. On the other hand, when the command signal B is input into the control means, and the paper width input into the paper width setting means is determined to be less than a predetermined value by the control means, the paper feeding motor is controlled to be driven by the control means, thereby feeding the paper until the fore end of the paper reaches a position opposed to the printing head. At this time, the centering means is also controlled to be driven by the control means, thereby moving the carrier to the transverse center of the paper. Accordingly, separation of the opposite side portions of the paper, which has a paper width less than the predetermined value in this case, from the platen can be suppressed, so that the paper can be smoothly fed with no interference with the paper bail roller contacting the platen in the paper feeding operation after starting the printing. In this way, the definition of the non-print area at the fore end of the paper can be selected with a simple structure.

According to a second aspect of the present invention, the above-mentioned paper feeder according to the first aspect further comprises a paper bail shaft for rotatably supporting the paper bail roller and a paper introducing member provided on the paper bail shaft for introducing the paper between the paper bail roller and the platen, the paper introducing member being opposed to the outer circumference of the platen with a predetermined space defined therebetween in the condition where the paper bail roller is in contact with the outer circumference of the platen.

With this construction, the fore end of the paper having passed the printing head can be smoothly introduced between the paper bail roller and the platen.

DETAILED DESCRIPTION OF THE PREFERRED EMBODIMENTS

Figure 3:
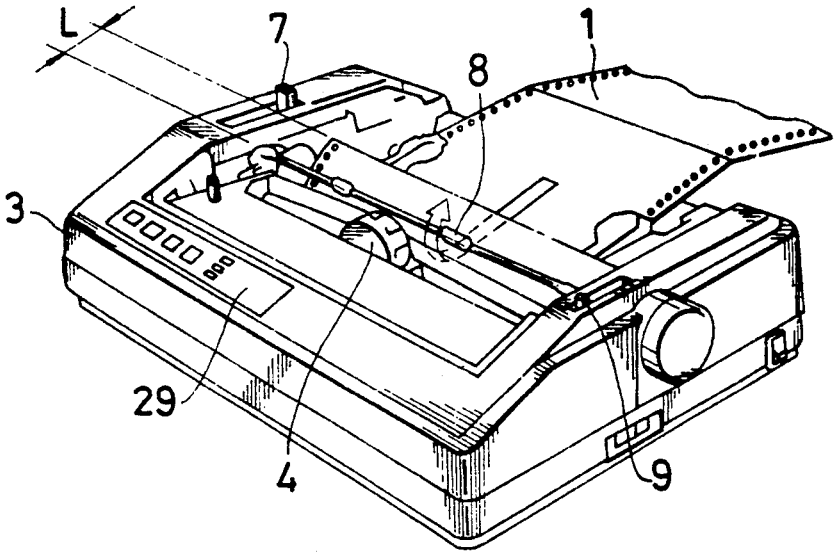
FIG. 3 is a perspective view of the paper feeder of the preferred embodiment, illustrating a paper feeding condition in case of using a continuous sheet of paper according to the preferred embodiment.
Figure 4:
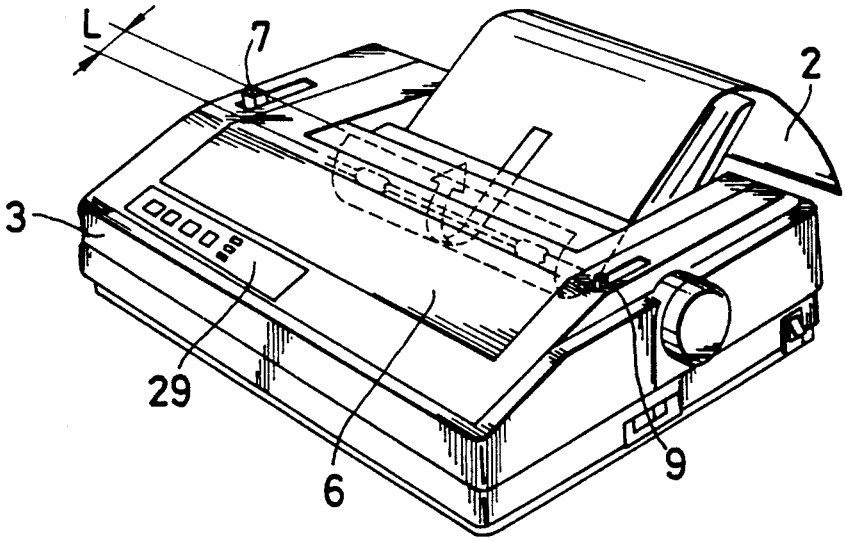
FIG. 4 is a view similar to FIG. 3, in case of using a cut sheet of paper according to the preferred embodiment.
Figure 5:
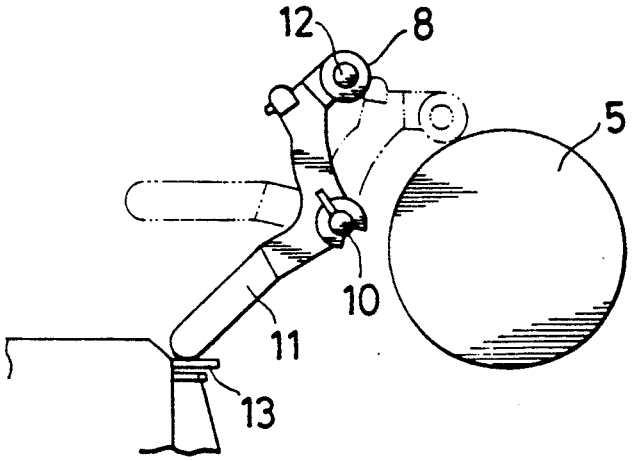
FIG. 5 is a side view of a supporting structure for paper bail rollers according to the preferred embodiment.

There will now be described a preferred embodiment of the paper feeder according to the first aspect of the present invention with reference to FIGS. 1 to 7. FIG. 3 is a perspective view illustrating a paper feeding condition where a continuous sheet of paper 1 is fed by the paper feeder, and FIG. 4 is a perspective view illustrating a paper feeding condition where a cut sheet of paper 2 is fed by the paper feeder. Referring to FIGS. 3 and 4, reference numeral 3 designates a housing of the paper feeder. On an upper surface of the housing 3, there is detachably provided a cover 6 for covering a printing head 4 and a platen 5 thereover. A friction release lever 7 for selectively bringing pinch rollers (not shown) into contact with or separation from the platen 5 is pivotably provided on a left side of the housing 3. A paper bail lever 9 for selectively bringing a plurality of paper bail rollers 8 into contact with or separation from the platen 5 is pivotably provided on a right side of the housing 3. As shown in FIG. 5, a pair of right and left arms 11 are rotatably supported to a shaft 10, so that the arms 11 can be rotated about the shaft 10 by operating the paper bail lever 9. A paper bail shaft 12 for rotatably supporting the paper bail rollers 8 is retained at its opposite ends to the respective upper ends of the arms 11. A paper bail switch 13 is so provided as to interfere with a lower end of one of the arms 11 as shown by a solid line in FIG. 5. In such an interfering condition, the paper bail switch 13 is turned on to output a detection signal A.

Figure 6:
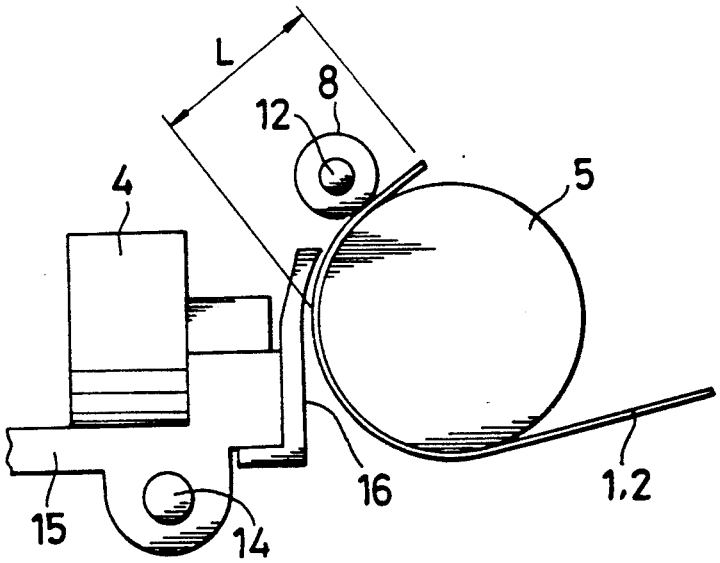
FIG. 6 is a side view of an essential part of the paper feeder, illustrating a paper feeding operation.

As shown in FIG. 6, a carrier shaft 14 extends in parallel to the platen 5, and a carrier 15 is slidably mounted on the carrier shaft 14. On the carrier 15, there are retained the printing head 4 and a paper guide 16 facing along an outer circumference of the platen 5.

Figure 1:
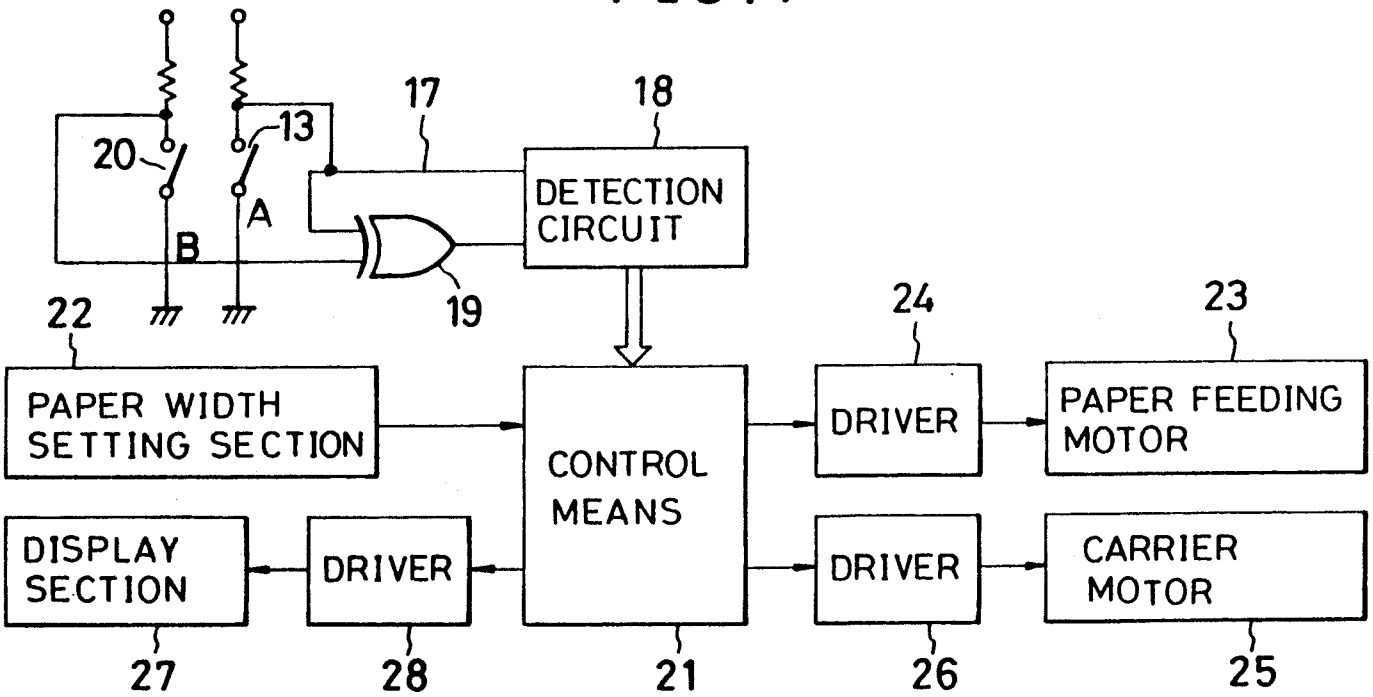
FIG. 1 is an electronic circuit diagram of a preferred embodiment according to the first aspect of the present invention.
Figure 2:
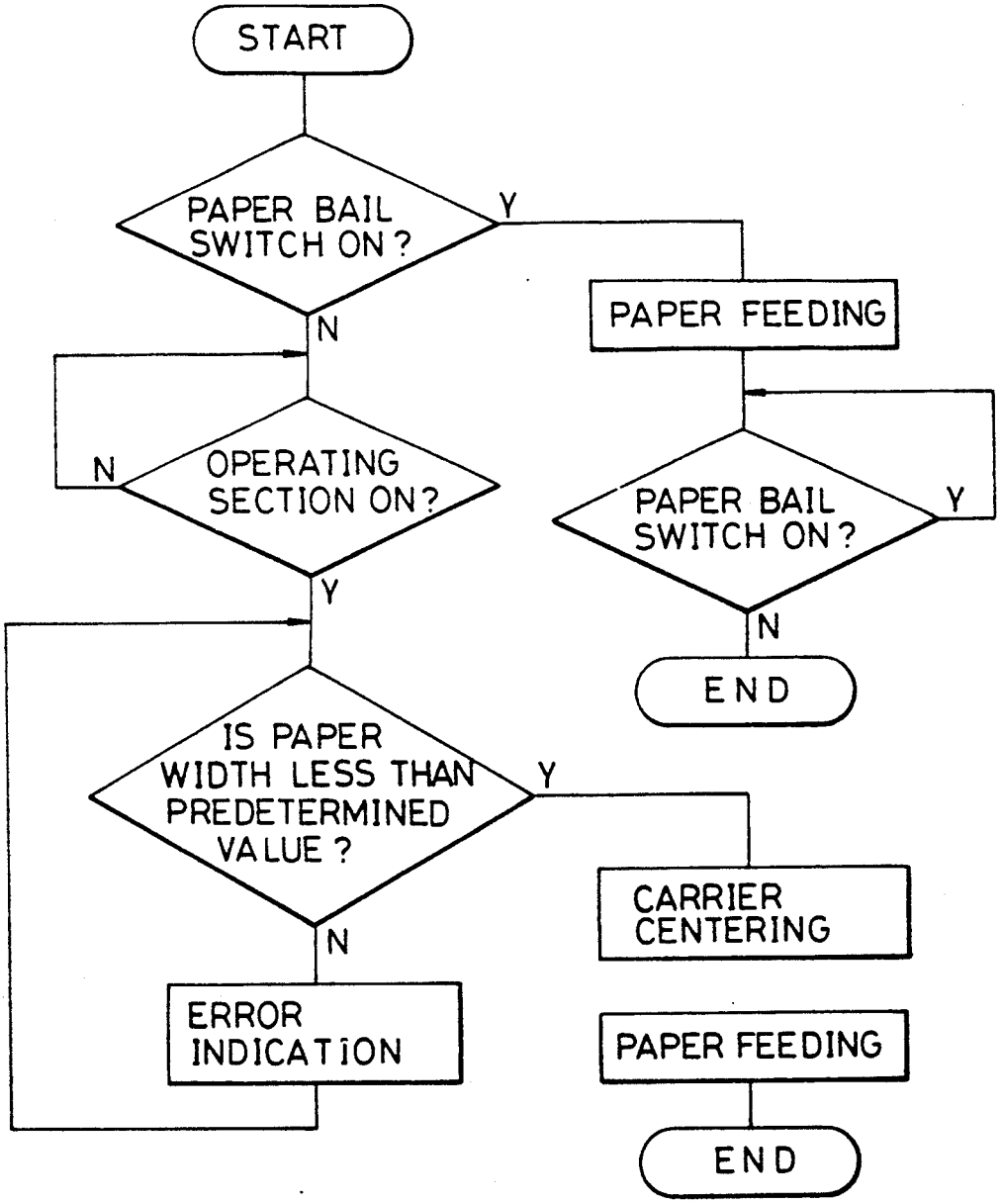
FIG. 2 is a flowchart illustrating the operation of the preferred embodiment.

Referring to FIG. 1 which shows an electronic circuit provided in the paper feeder, the paper bail switch 13 is connected through a signal line 17 to a detection circuit 18, and is also connected through an OR gate 19 to the detection circuit 18. An operating section 20 for generating a command signal B is connected through the OR gate 19 to the detection circuit 18. Control means 21 is connected to an output of the detection circuit 18. A paper width setting section 22 for setting a width of the paper 1 or 2 to be used is connected to an input of the control means 21. To an output of the control means 21 are connected a driver 24 for driving a paper feeding motor 23, a driver 26 for driving a carrier motor 25, and a driver 28 for driving a display section 27. The paper feeding motor 23 is connected to the platen 5, and the carrier motor 25 is connected through a belt or the like to the carrier 15. All of the operating section 20, the paper width setting section 22, and the display section 27 are arranged on an operation panel 29 provided on the housing 3. The control means 21 includes a CPU, a ROM previously storing programs, and a RAM for storing variable data.

In operation, the width of the paper 1 or 2 to be used is output from the paper width setting section 22. The paper feeding operation will now be described with reference to the flowchart shown in FIG. 2. In case of defining a non-print area (top margin) at a fore end portion of the paper 1 or 2, the paper bail lever 9 is manually operated to rotate the arms 11 and thereby bring the paper bail roller 8 into separation from the platen 5. As a result, one of the arms 11 is brought into interference with the paper bail switch 13, so that the paper bail switch 13 is turned on to generate the detection signal A. This detection signal A is detected in the detection circuit 18, and is then input into the control means 21. Then, the control means 21 controls operation of the driver 24 to drive the paper feeding motor 23 until the fore end of the paper 1 or 2 reaches the paper bail rollers 8. Thus, paper feeding is carried out. Subsequently, the paper bail lever 9 is manually operated to bring the paper bail rollers 8 into contact with the paper 1 or 2 on the platen 5. Accordingly, the paper bail switch 13 is turned off to end the paper feeding operation. Thereafter, printing operation is carried out. As shown in FIG. 6, a length L of the non-print area is defined between the fore end of the paper 1 or 2 and a position opposed to the printing head 4.

Figure 7A:
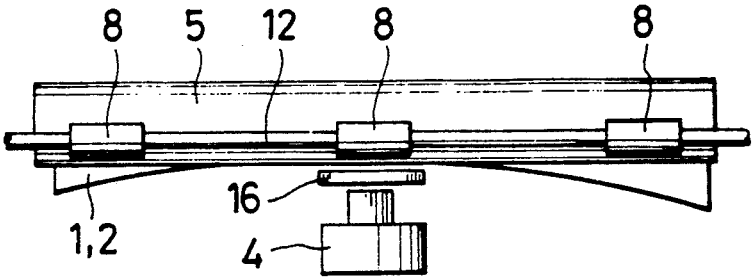
FIGS. 7A, 7B and 7C are plan views illustrating a positional relation between the paper and the printing head with a paper width changed.
Figure 7B:
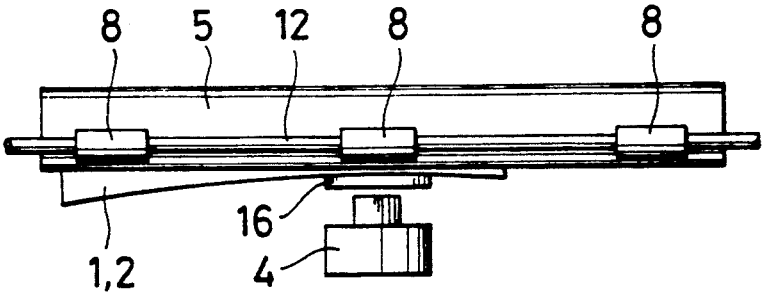
Figure 7C:
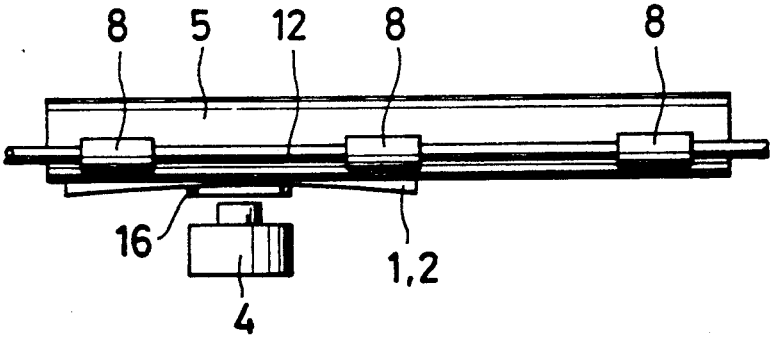
Figure 8:
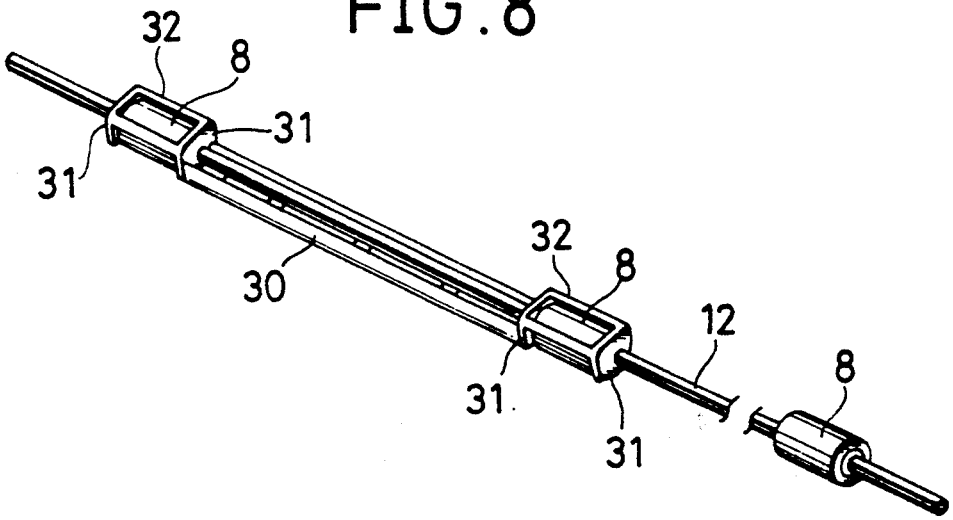
FIG. 8 is a perspective view of a supporting structure for a paper introducing member of a preferred embodiment according to the second aspect of the present invention.
Figure 9:
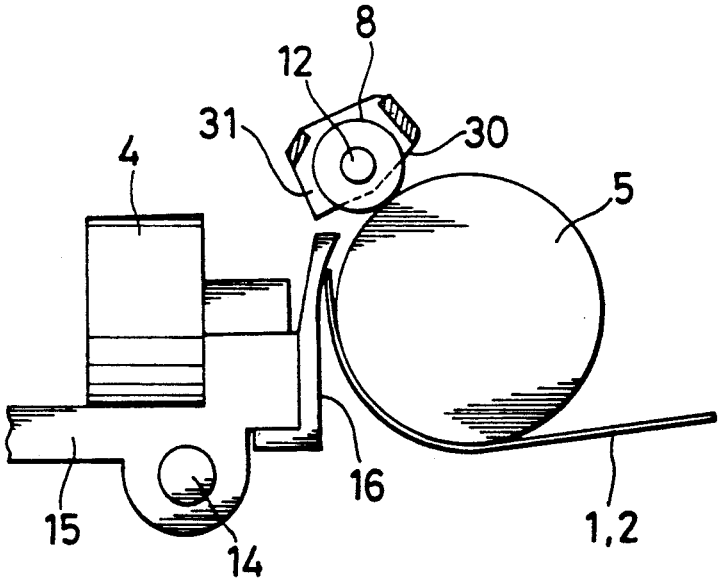
FIG. 9 is a side view of the supporting structure of the paper introducing member with an end portion thereof being shown in cross section.

In case of starting printing from the fore end of the paper 1 or 2, the paper bail rollers 8 are brought into contact with the platen 5 to turn off the paper bail switch 13. In this condition, the operating section 20 is operated. The command signal B output from the operating section 20 is detected in the detection circuit 18, and is then input into the control means 21. Then, the control means 21 determines whether or not the paper width set by the paper width setting section 22 is less than a predetermined value (e.g., a width of A4 size paper). If the answer is NO, that is, if the paper width is equal to or greater than the predetermined value, the paper feeding operation is not carried out. This is due to the fact that even if the transverse center of the paper 1 or 2 is supported by the paper guide 16, opposite side portions of the paper 1 or 2 become separate from the platen 5 and are apt to interfere with the paper bail rollers 8 or the paper bail shaft 12 as shown in FIG. 7A. Then, the control means 21 controls the driver 28 to display error indication on the display section 27. If the paper width set by the paper width setting means 20 is less than the predetermined value, the control means 21 executes carrier centering, and then controls the driver 24 to drive the paper feeding motor 23 until the fore end of the paper 1 or 2 reaches the position opposed to the printing head 4. Thus, the paper feeding is carried out. Thereafter, the printing operation is carried out. The above-mentioned carrier centering is executed by driving the driver 26 to move the carrier 15 with the printing head 4 to the transverse center of the paper 1 or 2. That is, if the paper guide 16 is deflected from the transverse center of the paper 1 or 2 as shown in FIG. 7B, one side portion of the paper 1 or 2 becomes separate from the platen 5 and is apt to interfere with the paper bail rollers 8 or the paper bail shaft 12. To avoid this possibility, the carrier 15 is moved together with the printing head 4 and the paper guide 16 to the transverse center of the paper 1 or 2, so as to support the paper 1 or 2 at the transverse center thereof as shown in FIG. 7C. Accordingly, the separation of the opposite side portions of the paper 1 or 2 from the platen 5 can be minimized, and in this condition, the paper 1 or 2 can be smoothly inserted between the platen 5 and the paper bail rollers 8 contacting the platen 5. The driver 26 functions as the centering means according to the present invention.

There will now be described a preferred embodiment of the paper feeder according to the second aspect of the present invention with reference to FIGS. 8 to 11, in which the same reference numerals as those shown in FIGS. 1 to 7 designate the same parts, and the explanation thereof will be omitted hereinafter. In this preferred embodiment, a paper introducing member 30 is mounted on the paper bail shaft 12 rotatably supporting the paper bail rollers 8 in the axial range from a central portion of the paper bail shaft 12 to one end portion thereof. The paper introducing member 30 is opposed to the outer circumference of the platen 5 with a predetermined space defined therebetween in the condition where the paper bail rollers 8 are in contact with the platen 5. The paper introducing member 30 is formed at its opposite ends with a pair of axial movement restricting portions 32 for restricting axial movement of the paper introducing member 30. That is, each axial movement restricting portion 32 has a pair of opposed plate portions 31 adapted to contact opposite end surfaces of the paper bail roller 8. Further, the plate portions 31 are non-rotatably mounted on the paper bail shaft 12.

Figure 10:
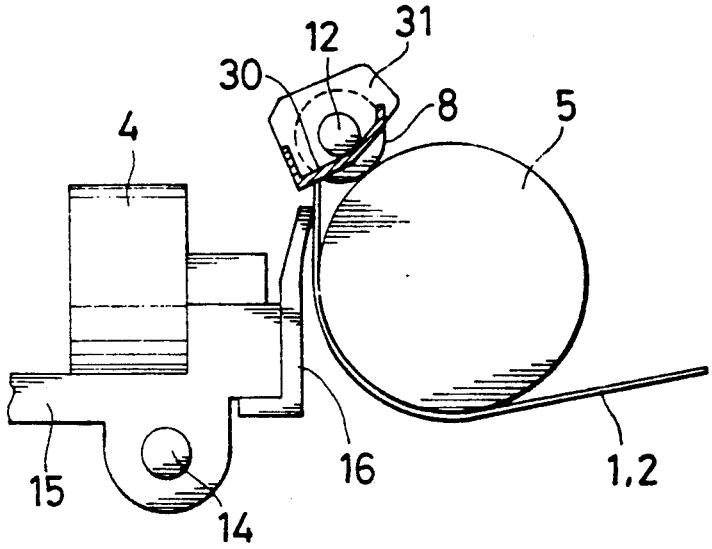
FIG. 10 is a view similar to FIG. 9 with a central portion of the paper introducing member being shown in cross section.
Figure 11:
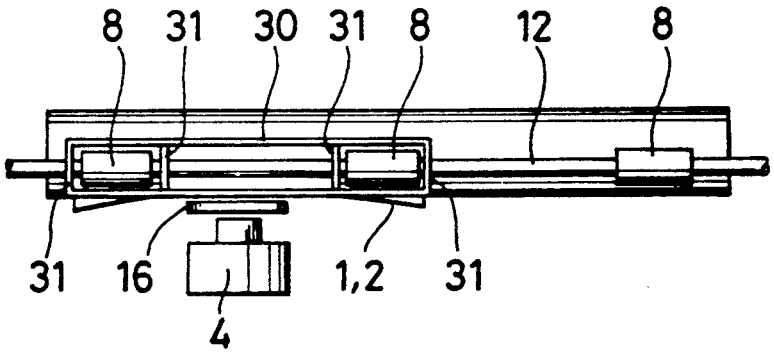
FIG. 11 is a plan view similar to FIG. 7C, according to the second aspect of the present invention.

In operation, the carrier 15 is moved to the transverse center of the paper 1 or 2 as shown in FIG. 11, and the paper feeding is then carried out. At this time, even if the opposite side portions of the fore end of the paper 1 or 2 become separate from the platen 5 as shown in FIG. 10, they can be reliably introduced between the paper bail rollers 8 and the platen 5 by means of the paper introducing member 30. Accordingly, it is possible to reliably avoid the possibility that the opposite side portions of the fore end of the paper 1 or 2 interfere with the paper bail rollers 8 and the paper bail shaft 12.

What is claimed is:

1. A paper feeder comprising: a housing; a carrier reciprocatably supported on said housing; a printing head fixedly mounted on said carrier; a platen rotatably supported to said housing; a paper feeding motor connected to said platen; a paper bail roller rotatably provided at a position downstream of said printing head with respect to the paper feeding direction and adapted to be brought into contact with or separation from an outer circumference of said platen; means for setting a paper width of a sheet of paper to be used; centering means for moving said carrier to a transverse center of said paper; a paper bail switch for detecting separation of said paper bail roller from the outer circumference of said platen; means for commanding paper feeding; a detection circuit for distinguishing a detection signal A output from said paper bail switch from a command signal B output from said commanding means; and control means having an input connected to said detection circuit and said paper width setting means and having an output connected to said paper feeding motor; wherein said control means comprises, when the detection signal A is input into said control means, means for producing a drive signal to drive said paper feeding motor until a fore end of the paper reaches said paper bail roller, and when the command signal B is input into said control means and the paper width set by said paper width setting means is less than a predetermined value, means for producing a centering signal to drive said centering means and thereby move said carrier to the transverse center area of the paper and means for producing a drive signal to drive said paper feeding motor until the fore end of the paper reaches a position opposed to said printing head, and when the command input B is input into said control means and the paper width set by said paper width setting means is greater than a predetermined value, means for inhibiting producing a drive signal to drive said paper feeding motor so that a paper feeding operation is not carried out.

2. The paper feeder as defined in claim 1 further comprising a paper bail shaft for rotatably supporting said paper bail roller and a paper introducing member provided on said paper bail shaft for introducing the paper between said paper bail roller and said platen, said paper introducing member being opposed to the outer circumference of said platen with a predetermined space defined therebetween in the condition where said paper bail roller is in contact with the outer circumference of said platen.

* * * * *